US005391474A

United States Patent [19]

Haefner et al.

[11] Patent Number: 5,391,474

[45] Date of Patent: Feb. 21, 1995

[54] IRIDIUM AND BROMIDE IN SILVER HALIDE GRAIN FINISH

[75] Inventors: John A. Haefner, Rush; Jess B. Hendricks, III, Rochester, both of N.Y.

[73] Assignee: Eastman Kodak Company, Rochester, N.Y.

[21] Appl. No.: 181,267

[22] Filed: Jan. 13, 1994

Related U.S. Application Data

[63] Continuation of Ser. No. 876,262, Apr. 30, 1992, abandoned.

[51] Int. Cl.[6] ..... G03C 1/015

[52] U.S. Cl. ..... 430/569; 430/604; 430/605

[58] Field of Search ..... 430/567, 569, 604, 605

[56] References Cited

U.S. PATENT DOCUMENTS

| | | | |
|---|---|---|---|
| 3,790,390 | 2/1974 | Shiba et al. | 430/567 |
| 3,901,713 | 8/1975 | Yamasue et al. | 430/569 |
| 4,173,483 | 11/1979 | Habu et al. | 430/575 |
| 4,693,965 | 9/1987 | Ihama et al. | 430/605 |
| 4,786,588 | 11/1988 | Ogawa | 430/603 |
| 4,902,611 | 2/1990 | Leubner et al. | 430/605 |
| 4,997,751 | 3/1991 | Kim | 430/605 |
| 5,070,008 | 12/1991 | Maekawa et al. | 430/605 |
| 5,153,110 | 10/1992 | Kawai et al. | 430/375 |
| 5,166,044 | 11/1992 | Asami | 430/567 |

FOREIGN PATENT DOCUMENTS

| | | | |
|---|---|---|---|
| 0273430 | 7/1988 | European Pat. Off. | 430/567 |
| 0312999 | 4/1989 | European Pat. Off. . | |
| 0325235 | 7/1989 | European Pat. Off. . | |
| 0350046 | 1/1990 | European Pat. Off. . | |
| 0350047 | 1/1990 | European Pat. Off. . | |
| 91/10166 | 7/1991 | WIPO | 430/604 |

OTHER PUBLICATIONS

Hidemaru Sakai and Shigeju Baba, J. Soc. Phot. of Japan, "Influence of Irridium Salts on the Silver Halide Emulsions (I) Effect on Reciprocity Law Failure of the Emulsions", vol. 31, Issue 1, 1969, pp. 34–40.

*Primary Examiner*—Janet C. Baxter
*Attorney, Agent, or Firm*—Paul A. Leipold

[57] ABSTRACT

The invention provides a process for incorporating iridium into silver chloride or silver chlorobromide emulsions containing 90% or more chloride which comprises addition of an iridium salt along with or followed by the addition of bromide to the emulsion, after completion of the precipitation stage of emulsion manufacture. The invention also encompasses the formed emulsions and photographic elements comprising the emulsions.

16 Claims, No Drawings

IRIDIUM AND BROMIDE IN SILVER HALIDE GRAIN FINISH

This is a continuation of application Ser. No. 876,262, filed Apr. 30, 1992, now abandoned.

FIELD OF THE INVENTION

The invention relates to sensitization of silver halide emulsions for use in photographic elements.

BACKGROUND OF THE INVENTION

There is an ongoing need in the photographic materials market to produce rapidly processable films and papers which demonstrate exceptionally high performance qualities. Rapid processing is made possible by the increase in the rate of development that comes from the use of silver chloride or silver chlorobromide emulsions of high chloride content. However, these emulsions have had characteristics that have not allowed the highest performance to be achieved. In particular there have been limitations in reciprocity and latent image keeping characteristics of these materials.

It is well known that silver halide emulsions can contain iridium ions and that the presence of iridium can have a significant effect on reciprocity failure. Reciprocity failure is the deviation from or non adherence to the reciprocity law which is described by the equation $E=IXT$ where E is exposure, I is intensity of the illumination falling on the sensitive material, and T is the length of the exposure also called the exposure time. Iridium is beneficial in reducing deviations from the reciprocity law. The iridium effect is commonly described as reducing reciprocity failure in that it minimizes changes in the photographic response characteristics of a material when a change is made in the time of light exposure given to a silver halide emulsion.

A general summary of the use of iridium in silver halide emulsions is contained in B. H. Carroll, "Iridium Sensitization: A Literature Review", Photographic Science and Engineering, Vol. 24, No. 6, 1980. At the 1982 International Congress of Photographic Science at the University of Cambridge, R. S. Eachus presented a paper titled "The Mechanism of $Ir^{+3}$ Sensitization in Silver Halide Materials".

Silver halide crystals which contain chloride and bromide ions and which have iridium added during their precipitation are also known to have a highly undesirable property of changing photographic performance as a function of the time that elapses between exposure and processing. A description of this behavior is contained in H. Zwicky, "On the Mechanism of the Sensitivity Increase With Iridium in Silver Halide Emulsions", The Journal of Photographic Science, Vol. 33, pp. 201–203, 1985. The behavior between the time of exposure and the time when processing starts is also called latent image keeping (LIK).

LIK change may be seen as either a loss in speed or density or a gain in speed or density depending on whether a blue, green, or red spectral sensitizing dye is present. In addition, changing the sensitizing dye can give a change in the magnitude or the LIK for a given reciprocity value.

THE INVENTION

The invention provides a process for incorporating iridium into silver chloride or silver chlorobromide emulsions containing 90% or more chloride which comprises addition of an iridium salt along with or followed by the addition of bromide to the emulsion, after completion of the precipitation stage of emulsion manufacture. The invention also encompasses the formed emulsions and photographic elements comprising the emulsions.

MODES FOR CARRYING OUT THE INVENTION

A highly desirable goal is to obtain a silver halide material of high chloride content which has little or no reciprocity failure and at the same time shows little or no LIK change. We have found a means of accomplishing this goal with the present invention.

The iridium source for use in this invention can be either a water soluble salt or a preformed silver halide crystal which contains iridium as a result of its addition during the making of the crystals. Iridium compounds can be $Ir^{+3}$ or $Ir^{+4}$ complexes containing halide. In accordance with this invention, iridium can be used in amounts from $1\times10^{-10}$ to $1\times10^{-5}$ moles per final sensitized emulsion. Preferably $2\times10^{-9}$ to $5\times10^{-6}$ moles per final mole are used for best color paper. The most desired level depends on the specific emulsion grain size and the extent of reciprocity control needed for a specific product application. It can be anywhere in the preferred range. It is noted that $1\times10^{-10}$ M=about 0.05 microg, $1\times10^{-5}$ M=about 5 mg $K_xIrCl_6$ where x=2 or 3.

The bromide source used in this invention can be selected from any of the common water soluble salts such as NaBr or KBr, or it can be from AgBr of AgClBr emulsions of fine grain particles made for the purpose of addition in the context of carrying out this invention. The fine grain emulsions are usually called Lippmann Emulsions. The bromide added in conjunction with the iridium can be in amounts from 0.10 to 10.0 mole percent of the final emulsion silver content. A range of 0.25 to 4.0 is preferred for best color paper performance.

After precipitation of the chlorobromide or chloride emulsion by any of the methods described in the art, the emulsion is preferably washed to remove the soluble salts. The iridium material may be added at any time after this washing step and before additionally added bromide completes its reaction with the cloride-containing emulsion substrate. The washing step, although commonly used, is not necessary for the invention. The described process may be carried out after precipitation of the high chloride or chloride emulsion without going through a washing step.

Other materials may be added before, during, or after addition of either the iridium or bromide material. These materials and methods to carry out chemical and spectral sensitization, to provide antifogging, stabilizing, and other properties important to photographic response are extensively described in the art. For practical manufacturing reasons it is advantageous to carry out chemical sensitization with a sulfur or gold compound, or a combination of these two; it is advantageous to add a spectral sensitizing dye or combination of dyes; it is advantageous to add antifoggant compounds or other organic compounds which absorb to silver halide surfaces—all or some of these contiguous with the iridium and bromide materials addition. It is known to add water and/or gelatin to change viscosity or emulsion concentration, and also it is known to make adjustments in pH and pCl of emulsions. These operations are also possible at any time or sequence while carrying out the process of this invention. It is also possible to perform chemical or spectral sensitization operations and additions of materials and other adjustment after the iridium-plus-bromide process has been performed.

The emulsions resulting from this invention can be coated on film or paper supports in formats and structures allowing the development of silver images or dye images. It is considered that the emulsions will find their preferred use in color paper.

The examples below are intended to illustrate this invention and further explain conditions-under which it operates.

EXAMPLES

The following examples are intended to be illustrative and not exhaustive of the methods of formation of the invention and the sensitized emulsions formed by the invention.

EXAMPLE 1 (COMPARISON EMULSIONS)

Emulsion 1: Undoped 0.31 micrometer AgCl/Br 15% Cl 85% Br

At 60° C., 100 g of gelatin were added to a reaction vessel containing 4 liters of water. The concentration was then adjusted to pBr=4.3 with a 3N salt solution made by dissolving 2306 g potassium bromide along with 255 g potassium chloride in water to give 6.0 liters of solution. This salt solution and a solution containing 2856 g of silver nitrate in water to give 5.6 liters of solution were added simultaneously to the stirred gelatin solution in a manner to maintain the stated silver potential. The delivery flows were adjusted so that 15 moles of the emulsion was precipitated in a period of 37.7 minutes. At this point the precipitation was ended and the emulsion washed to remove excess salts. The grains were cubic with an edge length of 0.31 micrometers.

Emulsion 2: Iridium doped 0.31 micrometer AgCl/Br 15% Cl 85% Br

This emulsion was prepared as Emulsion 1 except that after 58% of the silver solution wad added, the run was stopped, 0.075 g of $K_3IrCl_6$ dissolved in 375 ml of water was added to the reaction vessel, and then the silver and salt solution delivery resumed until 15 moles of emulsion was precipitated. The emulsion was washed as above and 0.31 micrometer cubic grains were obtained.

Emulsion 3: Iridium doped 0.31 micrometer AgCl 100% Cl 0% Br

This emulsion was prepared in a manner similar to Emulsion 1 except: 1) at 48° C., 240 g of gelatin, 0.6 g of a thioether silver halide ripening agent of the type disclosed in McBride U.S. Pat. No. 3,271,157, and 6 liters of water were added to the reaction vessel; 2) 2 molar solutions of sodium chloride and of silver nitrate were prepared and, after the reaction vessel was adjusted to a pCl=1.4, the two solutions were delivered simultaneously while controlling the potential at pCl=1.4; 3) a total of 8.0 moles of emulsion was prepared by reagent delivery over a 15-minute time period, 4) after 75% of the emulsion had been precipitated, an aqueous solution containing 8.0 mg of $K_3IrCl_6$ in 44.5 ml of solution was delivered to the reaction vessel while the salt and silver solutions continued to be delivered. After completion of the precipitation, the emulsion was washed to remove excess salts.

The emulsions were chemically sensitized, and spectrally sensitized with dye b, then were coated on a paper support at 0.28 g/m$^2$ silver with 0.42 g/m$^2$ magenta forming coupler B, to give a layer with 1.66 g/m$^2$ gelatin. A 1.1 g/m$^2$ gelatin protective overcoat layer was applied along with a vinylsulfone gelatin hardener.

The coatings were exposed through a step tablet to a 3000° K. light source for 0.1 second for all tests run and summarized in the data tables below. Processing was carried out as recommended in "Using KODAK EKTACOLOR RA Chemicals", Publication No. Z-130, published by Eastman Kodak Co., 1990.

The results in Table I show that a large LIK change occurs when iridium is incorporated in a silver chloride emulsion.

TABLE I

| | 5 Min. to 24 Hr. LIK* |
|---|---|
| Emulsion 1 | −20 |
| Emulsion 2 | −20 |
| Emulsion 3 | +280 |

*5 min. to 24 hr. LIK is defined as the change in speed expressed in units of log Ex1000 with the speed measured at a reflection density of 1.0 when the exposed sample is held 24 hours and then processed and compared to a sample of the same coating processed 5 minutes after exposure.

Emulsion 4–11: 0.38 AgCl (COMPARISON EMULSIONS)

Method of Preparation For Emulsions 4–11

These emulsions were precipitated as in Example 3 except:

1) The thioether silver halide ripening agent level was 0.2 g per liter of water in the reaction vessel.
2) The pCl was adjusted and controlled at 1.5.
3) The salt and silver reagent solutions were delivered in 21.5 minutes.
4) No $K_3IrCl_6$ was added for Emulsions 4 and 10.
5) For Emulsions 5, 6, 7, 8, 9, and 11, at the point during precipitation where 93% of the final grain volume had been formed, the $K_3IrCl_6$ solution was delivered in amounts listed in Table A below. The salt and silver reagent solution additions continued during the iridium solution addition which required 0.5 minutes after which the salt and silver reagent solution additions continued until emulsion precipitation was complete.

The washed emulsions were chemically sensitized with gold 1+ sensitizing salt as disclosed in U.S. Pat. No. 2,642,361 and heated to 65° C. In addition, 1-(3-acetamidophenyl)-5-mercaptotetrazole and one mole % bromide were added. Red (dye c,d), green (dye b), or blue (dye a) spectral sensitizing dye was added as indicated in Table A. The emulsions were next coated on a paper support at 0.18 g/m$^2$ silver with 0.45 g/m$^2$ cyan forming coupler A to give a layer with 0.166 g/m$^2$ gelatin. A 1.1 g/m$^2$ gelatin protective overcoat layer was applied along with a vinylsulfone gelatin hardener.

TABLE A

| | $K_3IrCl_6$ in the Precipitation | Dye |
|---|---|---|
| Emulsion 4 | 0 | + dye c |
| Emulsion 5 | 0.04 mg/M | + dye a |
| Emulsion 6 | 0.04 mg/M | + dye b |
| Emulsion 7 | 0.04 mg/M | + dye c |
| Emulsion 8 | 0.1 mg/M | + dye c |

TABLE A-continued

| | $K_3IrCl_6$ in the Precipitation | Dye |
|---|---|---|
| Emulsion 9 | 0.2 mg/M | + dye c |
| Emulsion 10 | 0.0 mg/M | + dye d |
| Emulsion 11 | 0.07 mg/M | + dye d |

LIK testing was done in the manner described above except exposed samples were held 30 minutes before processing and compared to samples held 5 minutes before processing.

These comparison example results summarized in Table II and Table III show that iridium incorporated in the precipitation step of emulsion preparation will produce undesirable LIK changes at the same time the iridium is used to reduce both high intensity (0.1 sec. to 0.02 sec.) and low intensity (0.1 sec. to 100 sec.) reciprocity failure. This is not the invention because iridium is added during the precipitation stage. The results are not the same as with the invention.

TABLE II

| | 5 Min. to 30 min. LIK* |
|---|---|
| Emulsion 5 | +4 |
| Emulsion 6 | +17 |
| Emulsion 7 | −10 |

TABLE III

| | LIK | SPEED CHANGE* | |
|---|---|---|---|
| | 5 min. to 30 min. | 0.1–0.02 sec. | 0.1–100 sec. |
| Emulsion 4 | +4 | −6 | −48 |
| Emulsion 8 | −12 | +2 | −15 |
| Emulsion 9 | −11 | 0 | −10 |
| Emulsion 10 | −1 | −3 | −25 |
| Emulsion 11 | −24 | +1 | −8 |

*Speed loss (−) or gain (+) is expressed in units of logE × 100 obtained when either the 0.02 sec. or the 100 sec. exposure result is compared to the 0.1 sec. exposure when all speeds are measured at a reflection density of 1.0.

Emulsion 12 0.38 micrometer (COMPARISON)

The emulsion precipitated and washed as in Emulsions 4 and 10, that is, with no iridium added during these operations, was treated with gold sensitizer as in Emulsions 4–11 and subsequently bis-azine as disclosed in U.S. Pat. No. 5,061,618, 1-(3-acetamidophenyl)-5-mercaptotetrazole, and one mole % potassium bromide was added at 65° C. Spectral sensitizing dye d was then added to complete the preparation of Emulsion 12.

Emulsion 13 0.38 micrometer (INVENTION)

The emulsion precipitated and washed as in Emulsions 4 and 10, that is, with no iridium added during these operations, was treated with gold sensitizer as in Emulsions 4–11 and subsequently bis-azine as in Example 12, 1-(3-acetamidophenyl)-5-mercaptotetrazole, an aqueous solution of $K_2IrCl_6$ was added in an amount to give 0.15 mg per mole of silver of $K_2IrCl_6$, and then one mole % bromide was added at 65° C. Spectral sensitizing dye d was then added to generate Emulsion 13.

Emulsion 14 0.38 micrometer (INVENTION)

This emulsion was prepared exactly as Emulsion 13 except 0.20 mg per mole of silver of $K_2IrCl_6$ was added.

Emulsions 12, 13, and 14 were coated as described for Emulsions 4–11 above. These samples are listed in Table B.

TABLE B

| | |
|---|---|
| Emulsion 12 | no $K_2IrCl_6$ added |
| Emulsion 13 | 0.15 mg/M $K_2IrCl_6$ added before the bromide solution |
| Emulsion 14 | 0.20 mg/M $K_2IrCl_6$ added before the bromide solution |

LIK and reciprocity testing was carried out in the above-described manner and the results are given in Table IV. It can be seen that the iridium salt introduced by the invention reduces both high (0.1–0.02 sec.) and low (0.1–100 sec.) intensity reciprocity failure without creating a LIK change.

TABLE IV

| | LIK | SPEED CHANGE* | |
|---|---|---|---|
| | 5 min. to 30 min. | 0.1–0.02 sec. | 0.1–100 sec. |
| Emulsion 12 | 0 | −7 | −22 |
| Emulsion 13 | 0 | 0 | −15 |
| Emulsion 14 | 0 | 0 | −9 |

Emulsion 15 0.38 micrometer AgCl (COMPARISON)

The emulsion was prepared as in Emulsion 12 except no bis-azine was added and dye c was added.

Emulsion 16 0.38 micrometer AgCl (INVENTION)

The emulsion was prepared as in Emulsion 15 except 0.05 mg per mole of silver of $K_3IrCl_6$ was added before the bromide solution.

Testing as above gave the results in Table V which shows that $K_3IrCl_6$ can also be used as an iridium source to minimize reciprocity without changing the LIK response.

TABLE V

| | LIK | SPEED CHANGE |
|---|---|---|
| | 5 min. to 30 min. | 0.1–100 sec. |
| Emulsion 15 Comparison | +10 | −17 |
| Emulsion 16 Invention 1 | +10 | −1 |

Emulsion 17 0.78 micrometer AgCl (COMPARISON)

An emulsion was precipitated as Emulsion 4 except:

1) The thioether silver halide ripening agent level was 0.3 g per liter of water in the reaction vessel.
2) The reaction vessel was maintained at 68° C.
3) The salt and silver solutions were delivered in 34 minutes with the pCl adjusted and controlled at a value of 1.1.

After washing, the emulsion was chemically and spectrally sensitized as described for Emulsions 4–15 except blue sensitizing dye a was used, no bis-azine was added, and additions were carried out at 60° C. No $K_2IrCl_6$ was added.

Emulsion 18 0.78 micrometer AgCl (INVENTION)

This emulsion was prepared exactly as Emulsion 17 except a solution of $K_2IrCl_6$ was added in an amount to give 0.01 mg per mole of silver of the $K_2IrCl_6$. This solution was added before the bromide solution.

Emulsion 17 no Iridium

Emulsion 18 0.01 mg/M $K_2IrCl_6$ added before bromide

Emulsion samples 17 and 18 were coated on a paper support in the blue sensitive layer (no. 1) of a multilayer composition as follows:

The following layers were coated in order on a the paper support:

7. Overcoat layer:
   Gelatin (1.1 g/m$^2$)
6. UV absorbing layer:
   A mixture of hydroxyphenylbenzotriazoles (0.38 g/m$^2$) oxidized developer scavenger (0.09 g/m$^2$), gelatin (0.72 g/m$^2$)
5. Red sensitive layer:
   Chemically and red spectrally sensitized monodisperse silver chloride negative emulsion (0.21 g Ag/m$^2$) and cyan-dye forming coupler A (0.42 g/m$^2$) in di-n-butyl phthalate coupler solvent (0.21 g/m$^2$), gelatin (1.1 g/m$^2$)
4. UV absorbing layer:
   A mixture of hydroxyphenylbenzotriazoles (0.38 g/m$^2$) oxidized developer scavenger (0.09 g/m$^2$), gelatin (0.72 g/m$^2$)
3. Green sensitive layer:
   Chemically and green spectrally sensitized monodisperse silver chloride negative emulsion (0.27 g Ag/m$^2$) and magenta-dye forming coupler B (0.39 g/m$^2$) in di-n-butyl phthalate coupler solvent (0.15 g/m$^2$), gelatin (1.2 g/m$^2$)
2. Interlayer:
   oxidized developer scavenger (0.09 g/m$^2$) Gelatin (0.75 g/m$^2$)
1. Blue sensitive layer:
   Chemically and blue spectrally sensitized monodisperse silver chloride negative emulsion (0.24 g Ag/m$^2$) and yellow-dye forming coupler C (1.1 g/m$^2$) in di-n-butyl phthalate coupler solvent (0.27 g/m$^2$), gelatin (1.5 g/m$^2$)

Support: A paper stock consisting of a mixture of hard and soft wood pulp extrusion overcoated with a titanium dioxide and zinc oxide pigmented polyethylene layer.

The layers 1–7 were hardened with bis(vinylsulfonyl)methyl ether at 11.9% of the total gelatin weight. Coupler identifications are:

A=cyan dye-forming coupler: (2-(α-(2,4-di-tert-amylphenoxy)butyramido-4,6-dichloro-5-ethyl phenol B=magenta dye-forming coupler: 1-(2,4,6-trichlorophenyl)-3-(2-chloro-5-(α-(4-hydroxy-3-tert-butylphenoxy)tetradecanoamido)anilino)-5-pyrazolone C=yellow dye-forming coupler: α(4-(4-benzyloxyphenyl sulfonyl)phenoxy)-α-(pivalyl)-2-chloro-5-(γ-(2,4-di-tamylphenoxy)butyramido)acetanilide Testing was performed in the above-described manner. Again, it is seen in Table VI that reciprocity is improved without significant change in LIK signal.

TABLE VI

| | LIK | SPEED CHANGE* | |
|---|---|---|---|
| | 5 sec. to 5 min. | 0.5–0.03 sec. | 0.5–128 sec. |
| Emulsion 17 | 6 | −9 | −15 |
| Emulsion 18 | 7 | −1 | −5 |

a.

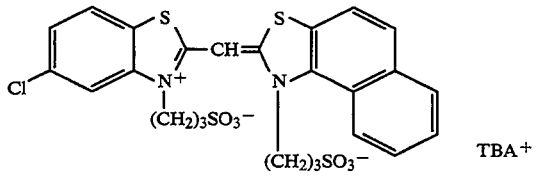

b.

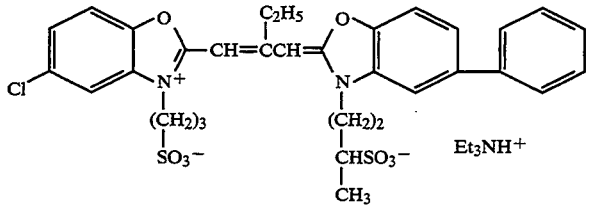

c.

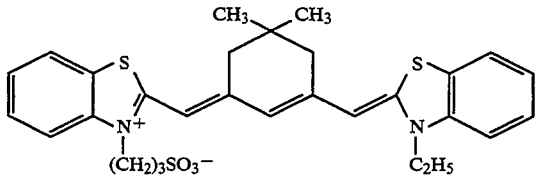

d.

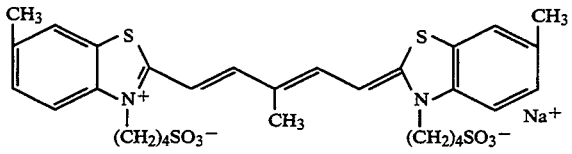

-continued

COUPLER A

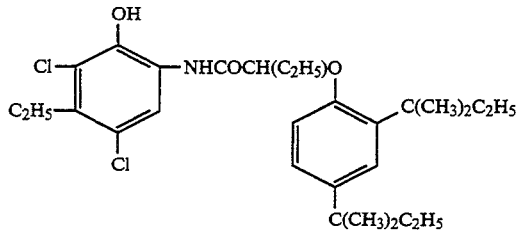

COUPLER B

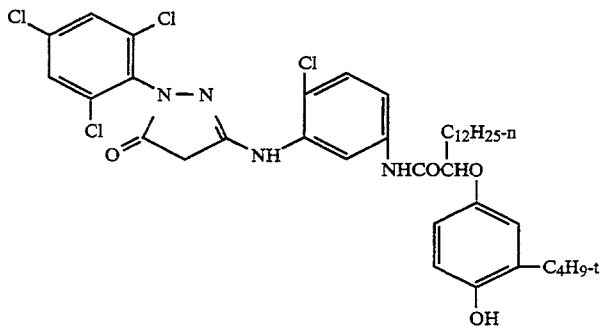

COUPLER C

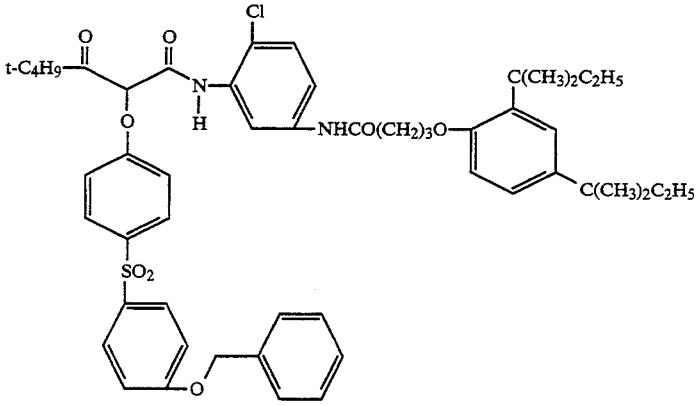

The invention has been described in detail with particular reference to preferred embodiments thereof, but it will be understood that variations and modifications can be effected within the spirit and scope of the invention.

We claim:

1. A process for forming an emulsion with reduced reciprocity failure comprising forming an emulsion comprising at least 90 percent silver chloride, washing said emulsion, and after the completion of emulsion formation and said washing, chemically sensitizing said emulsion with gold sensitizing salt, adding an iridium complex containing halogen ligands and adding bromide after said iridium complex.

2. The process of claim 1 wherein the amount of said iridium complex comprises between $1\times10^{-10}$ and $1\times10^{-5}$ moles per mole of silver in said emulsion.

3. The process of claim 1 wherein iridium is added in an amount of between $2\times10^{-9}$ and $5\times10^{-6}$ mole per mole of silver in said emulsion.

4. The process of claim 1 wherein said bromide is present in an amount of between 0.25 and 4 mole percent based on the silver content of said emulsion.

5. The process of claim 1 wherein said iridium complex comprises $K_2IrCl_6$ or $K_3IrCl_6$.

6. The process of claim 1 wherein said bromide is added as particles of silver bromide.

7. The process of claim 1 wherein said silver chloride emulsion is 100 percent silver chloride prior to said sensitizing.

8. The process of claim 1 wherein said iridium complex is added after chemical sensitization with said gold sensitizing salt.

9. The process of claim 1 wherein said silver halide emulsion contains up to 10 percent silver bromide prior to sensitization.

10. A process for forming an emulsion with reduced reciprocity failure comprising forming an emulsion comprising at least 90 percent silver chloride, washing said emulsion, and after the completion of emulsion manufacture and said washing, chemically sensitizing said emulsion with gold sensitizing salt, adding an iridium complex containing halogen ligands and adding bromide simultaneously with said iridium complex with the proviso that the amount of said iridium complex comprises between $1\times10^{-10}$ and $1\times10^{-5}$ moles per mole of silver in said emulsion and said bromide is present in an amount of between 0.25 and 4 mole percent based on the silver content of said emulsion.

11. The process of claim 10 wherein iridium complex is added in an amount of between $2\times10^{-9}$ and $5\times10^{-6}$ per mole of silver in said emulsion.

12. The process of claim 10 wherein said iridium complex comprises $K_2IrCl_6$ or $K_3IrCl_6$.

13. The process of claim 10 wherein said bromide is added as particles of silver bromide.

14. The process of claim 10 wherein said silver chloride emulsion is 100 percent silver chloride prior to said sensitizing.

15. The process of claim 10 wherein said iridium complex is added after chemical sensitization with said gold sensitizing salt.

16. The process of claim 10 wherein said silver halide emulsion contains up to 10 percent silver bromide prior to sensitization.

* * * * *